US007117658B2

(12) United States Patent
Malini

(10) Patent No.: US 7,117,658 B2
(45) Date of Patent: Oct. 10, 2006

(54) APPARATUS FOR WRAPPING GROUPS OF PRODUCTS

(75) Inventor: Massimo Malini, Bologna (IT)

(73) Assignee: Aetna Group, S.p.A., Villa Verucchio (IT)

( * ) Notice: Subject to any disclaimer, the term of this patent is extended or adjusted under 35 U.S.C. 154(b) by 0 days.

(21) Appl. No.: 10/771,905

(22) Filed: Feb. 4, 2004

(65) Prior Publication Data

US 2005/0016127 A1 Jan. 27, 2005

(30) Foreign Application Priority Data

Jul. 22, 2003 (IT) ..... BO2003A0436

(51) Int. Cl.
*B65B 11/00* (2006.01)

(52) U.S. Cl. ..... 53/588; 53/557; 53/66

(58) Field of Classification Search ..... 53/588, 53/589, 590, 591, 557, 66, 582, 399
See application file for complete search history.

(56) References Cited

U.S. PATENT DOCUMENTS

| | | | | |
|---|---|---|---|---|
| 3,791,100 | A * | 2/1974 | Monaghan | 53/74 |
| 3,830,036 | A * | 8/1974 | Harkness et al. | 53/76 |
| 4,041,674 | A * | 8/1977 | Reid | 53/496 |
| 4,233,012 | A * | 11/1980 | Willwerth et al. | 425/162 |
| 4,574,565 | A * | 3/1986 | Gambetti | 53/442 |
| 4,590,746 | A * | 5/1986 | Humphrey | 53/556 |
| 4,693,053 | A * | 9/1987 | Ballestrazzi et al. | 53/389.5 |
| 4,875,329 | A * | 10/1989 | Miselli | 53/559 |
| 5,203,144 | A * | 4/1993 | Gambetti | 53/465 |

(Continued)

FOREIGN PATENT DOCUMENTS

| | | | |
|---|---|---|---|
| EP | 0 581 747 | * | 2/1994 |
| EP | 0 612 661 | | 8/1994 |
| EP | 0 839 723 | | 5/1998 |
| EP | 0 839 723 | A1 | 5/1998 |
| EP | 1 256 519 | A1 | 5/2002 |
| EP | 1 256 519 | * | 11/2002 |

OTHER PUBLICATIONS

European Search Report corresponding to EP Application No. 04 42 5092.

*Primary Examiner*—Rinaldi I. Rada
*Assistant Examiner*—Paul Durand
(74) *Attorney, Agent, or Firm*—Fay, Sharpe, Fagan, Minnich & McKee, LLP

(57) ABSTRACT

An apparatus for wrapping groups (1) of products (2) with film (3), comprises: a second surface (6) for forming the product groups (1) and wrapping them with a length of film (3) using suitable means (7) having a first drive axis (AE1); a unit (8) for feeding the film (3) and defining the length of it by cutting, located under and close to a slot (9) for accessing the second surface (6), the feed unit (8) having a second, electric drive axis (AE2) for unwinding the film (3) in the direction of the second surface (6); a unit (10) for pre-unwinding the film (3) and comprising a roll (11) of film (3) located upstream of the feed unit (8) in a film (3) unwinding direction (B), a third electric drive axis (AE3) being located and operative on the pre-unwinding unit (10) to move the film (3) towards the feed unit (8) according to the film (3) requirement or feed speed of the second electric axis (AE2); and a unit (12) which controls the second and third electric axes (AE2, AE3) and which is located and operative between the two electric axes so as to synchronize the control of film (3) feed.

17 Claims, 3 Drawing Sheets

U.S. PATENT DOCUMENTS 5,203,146 A * 4/1993 Gambetti ..... 53/557
5,463,846 A * 11/1995 Gambetti ..... 53/465
6,305,145 B1 * 10/2001 Suolahti ..... 53/64
6,474,041 B1 * 11/2002 Gambetti ..... 53/141
6,739,115 B1 * 5/2004 Malini ..... 53/588
6,775,961 B1 * 8/2004 Cook et al. ..... 53/556

* cited by examiner

APPARATUS FOR WRAPPING GROUPS OF PRODUCTS

BACKGROUND OF THE INVENTION

The present invention relates to an apparatus for wrapping groups of products with plastic film, especially heat-shrink film.

The apparatus applies to the field of product packaging machines, with particular reference to the treatment of products of cylindrical or parallelepiped shape, such as bottles, cans and the like.

At present, automatic machines of this type present a line for processing and feeding bottles (this specific term being used for convenience of description, without thereby excluding products of a different shape) to a series of stations for positioning and collating the products, and for wrapping the resulting product groups with plastic film.

The positioning and collating stations are designed to form groups with a preset number of products, which may vary according to the size of the product and of the package to be made (in the case of bottles, for example, each group may consist of two rows of three bottles each), and to convey the products to the wrapping stations, at the end of which each group of products formed leaves the station and is fed to an end station where the packaging process is completed, usually with heat-shrink film.

The wrapping station includes a roll feed system constituting a station for continuously feeding heat-shrink plastic film (used to wrap the products) and located at a level below the conveyor along which the products are moving.

The roll feeds a unit for defining and cutting the length of film necessary to wrap the group of products in a direction corresponding to the direction of product feed as far as the product conveyor.

According to known methods, a wrapping "bridge" on the conveyor guides the film (suspended on crosspieces driven by parallel chains on both sides of the crosspieces themselves) over the product groups, passing through a slot, in such manner as to wrap the product group as it moves along the conveyor.

In practice, the group of products is wrapped by the film being unwound in the same direction as the products are being fed, the ends of the film partially overlapping after the wrapping operation and leaving an opening in the wrapping at the vertical lateral faces of the group itself. The tightening of the film over the product is accomplished by the typical heat-shrink properties of the film, as is very well known in the trade.

Up to now, based on this machine structure, attempts have been made to improve productivity and to reduce down time, for example, for size changeover, requiring various operations on the drive units (such as those of the unit which feeds and cuts the film, so as to change the size of the film lengths), and mechanical down time, for example, due to adjustments with manual means in the height of the structure which drives the film lifting and guide crosspieces.

For this reason, the Applicant designed and built a feed and cutting unit (see patent EP 839.723) located immediately below the slot for film feed to the wrapping surface and consisting of a pair of counter-rotating rollers between which the film to be fed is inserted, at a tangential point of contact. The first roller has a radially projecting blade, whilst the second roller has a radial groove which accommodates the blade during a cutting rotation, and a flat facet on its surface, forming a channel for the free transit of the film.

This structure significantly improves film feed and cutting, making it almost continuous, and speeds up changeover procedures in terms of the length and formation of the length of film to be used on the groups of products.

Following these improvements to the film feed and forming unit, the Applicant has also designed and built an improved unit for wrapping the groups of products (see Italian patent application BO2001A000284). This improved unit consists of at least one crosspiece for supporting and guiding the film, supported at one end by a single, motor-powered bar, positioned close to one side of the conveyor surface, and adjusting means acting at least upon the single bar and designed to allow a rotation of the crosspiece between a first, active trajectory, extending over the conveyor surface, and a second, return trajectory, extending under the conveyor surface, following an arc-shaped path whose distance from the conveyor surface varies and may be preset according to the dimensions of the group of products to be wrapped.

This constructional architecture has made it possible to further increase wrapping speed and reduce changeover down time, connecting the drive and control system of the wrapping unit to the film feed and cutting unit, the latter consisting of pairs of feed rollers mounted on both sides of a film cutting unit.

After numerous tests, however, it has now been found that the increased wrapping speed and faster changeover time have upset the normal functioning of the traditional station for unwinding the film from the roll.

Indeed, in current machines, the pre-unwinding station consists of the aforementioned roll of film and of a roller (usually known as "dandy roller) that moves with rocking motion, located downstream of the roll in the unwinding direction of the film and acting as a feed buffer keeping the cutting unit supplied with film.

Since the operation of the cutting unit depends on the system described above, it is subjected to irregular requests for film feed, due above all to the faster rate at which the groups of products are wrapped and which is not compensated by the pre-unwinding unit.

This irregularity may cause the film to be elastically deformed or move off its feed path as it travels from the dandy roller to the cutting station just under the working surface.

This may lead to unwanted waviness or folds in the film being fed to the cutting unit, which may in turn result in the film being cut erratically and to incorrect lengths.

Moreover, the area close to the cutting unit is, used for centering the printed spots on the film so that the latter is correctly positioned on the group of products: it is evident that deformation or waviness in the film prevents the printed spots from being correctly positioned when the length of film is cut.

The present invention therefore has for an aim to overcome the above mentioned drawbacks through an apparatus for wrapping groups of products with plastic film structured in such a way as to provide high productivity and to significantly reduce changeover down time while at the same time offering a high degree of film unwinding precision suited to the productivity of the apparatus, but without altering the basic structure of the apparatus itself.

SUMMARY OF THE INVENTION

According to the invention, this aim is achieved by an apparatus for wrapping products with plastic film and including the following: a second surface for forming the product groups and wrapping them with a length of film using suitable means having a first drive axis; a unit for feeding the film and defining the length of it by cutting, located under and close to a slot for accessing the second surface; the feed unit having a second, electric drive axis for unwinding the film in the direction of the second surface; a unit for pre-unwinding the film and comprising a film roll located upstream of the feed unit in the film unwinding direction; a third electric drive axis being located and operative on the pre-unwinding unit to move the film towards the feed unit according to the film requirement or feed speed of the second electric axis, and a unit which controls the second and third electric axes and which is located and operative between the two electric axes so as to synchronize the control of film feed.

BRIEF DESCRIPTION OF THE DRAWINGS

The technical characteristics of the invention, with reference to the above aims, are clearly described in the claims below and its advantages are apparent from the detailed description which follows, with reference to the accompanying drawings which illustrate a preferred embodiment of the invention provided merely by way of example without restricting the scope of the inventive concept, and in which:

DESCRIPTION OF THE PREFERRED EMBODIMENTS

Figure 1:
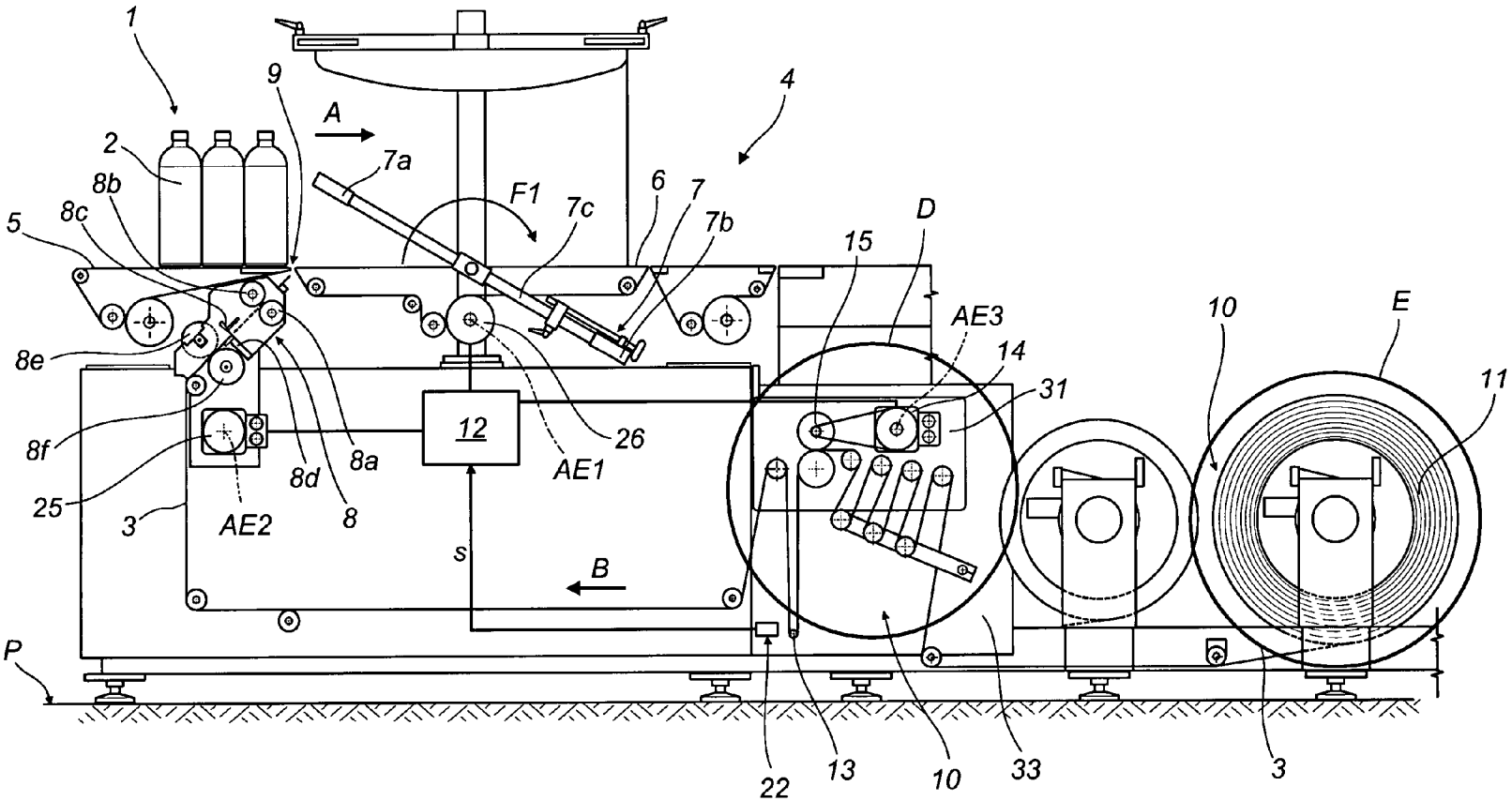
FIG. 1 is a schematic side view, with some parts cut away to better illustrate others, of an apparatus according to the present invention for wrapping groups of products with film.

With reference to the accompanying drawings, in particular FIG. 1, the apparatus according to the invention, denoted in its entirety by the numeral 4, is used to wrap groups 1 of products 2 with film 3, especially, but not restricted to, heat shrink film.

The products 2 illustrated in FIG. 1 are bottles, purely by way of example and without thereby excluding products of a different shape from the scope of the invention.

At the stations relevant to the present invention, the apparatus 4 comprises the following:

a first surface 5, moving in a direction A (see arrow A in FIG. 1, for conveying products 2 to a second surface 6 for forming the product groups 1 and wrapping the groups 1 thus formed with a length of film 3 using suitable wrapping means 7 having a first drive axis AE1;

a film 3 feed unit 8 which, by cutting, defines a length of film 3 whose size depends on the dimensions of the group 1 of products to be wrapped; the unit 8 being located below and close to a slot 9 separating the first and second surfaces 5 and 6; the unit 8 having a second electric drive axis AE2 to enable a defined quantity of film 3 to be unwound in the direction of the second surface 6;

a unit 10 for pre-unwinding the film 3 and comprising a roll 11 of film 3 located upstream of the feed unit 8 in a film 3 unwinding direction B and under the two surfaces 5 and 6.

In addition to this, the pre-unwinding unit 10 comprises a third, electric drive axis AE3 located and operative on the pre-unwinding unit 10 to move the film 3 towards the feed unit 8 according to the film 3 requirement or feed speed controlled by the second electric axis AE2 of the feed unit 8.

The numeral 12 denotes a unit which controls the second and third electric axes AE2 and AE3 and which is located and operative between the two electric axes AE2 and AE3 themselves so as to synchronize the control of film 3 feed.

Looking more closely at the constructional details of the apparatus 4 with reference to FIG. 1, the wrapping means 7, of known type and therefore not described in detail, consist of a pair of rods 7*a* and 7*b* supported by a single bar 7*c* that rotates (see arrow F1) on one side of the second surface 6, while the film feed unit 8, also of known type, comprises two pairs of feed rollers 8*a*, 8*b* and 8*e*, 8*f* located on both sides of an assembly consisting of a knife 8*c* and a counter-knife 8*d*.

Figure 2:
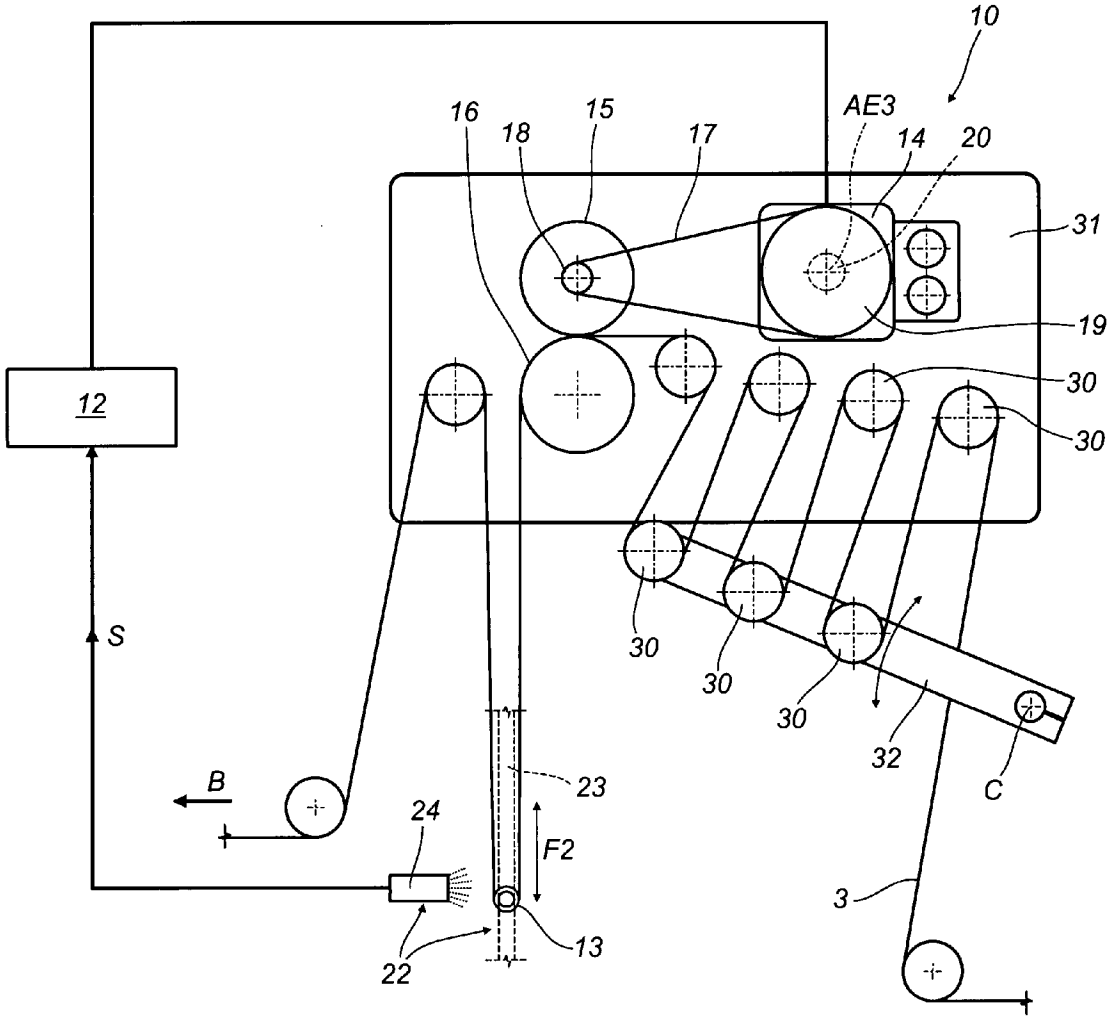
FIG. 2 is a scaled-up detail D from FIG. 1, showing a film pre-unwinding unit in a schematic side view.

As shown in FIGS. 1 and 2, the third electric axis AE3 may be located between the roll 11 and a roller 13 that controls the unwinding of the film 3.

In this specific case, the third electric axis AE3 may comprise a third variable phase drive 14 positioned between the roll 11 and the roller 13, and a pair of film 3 feed rollers 15 and 16, one of which is kinematically connected to the third drive 14.

The roller labeled 15 and the third drive 14 are kinematically connected by an endless toothed belt 17 trained around respective wheels 18 and 19 keyed, respectively, to the roller 15 and to a shaft 20 protruding from the third drive 14.

Besides this, the roll 11 and the pair of rollers 15 and 16 have located between them a plurality of idle film 3 tensioning rollers 30 some of which are mounted on a fixed plate 31 that mounts the third drive 14, while the others are mounted on a rocker arm 32 pivoted at C on a frame 33 forming part of the apparatus 4.

Figure 3:
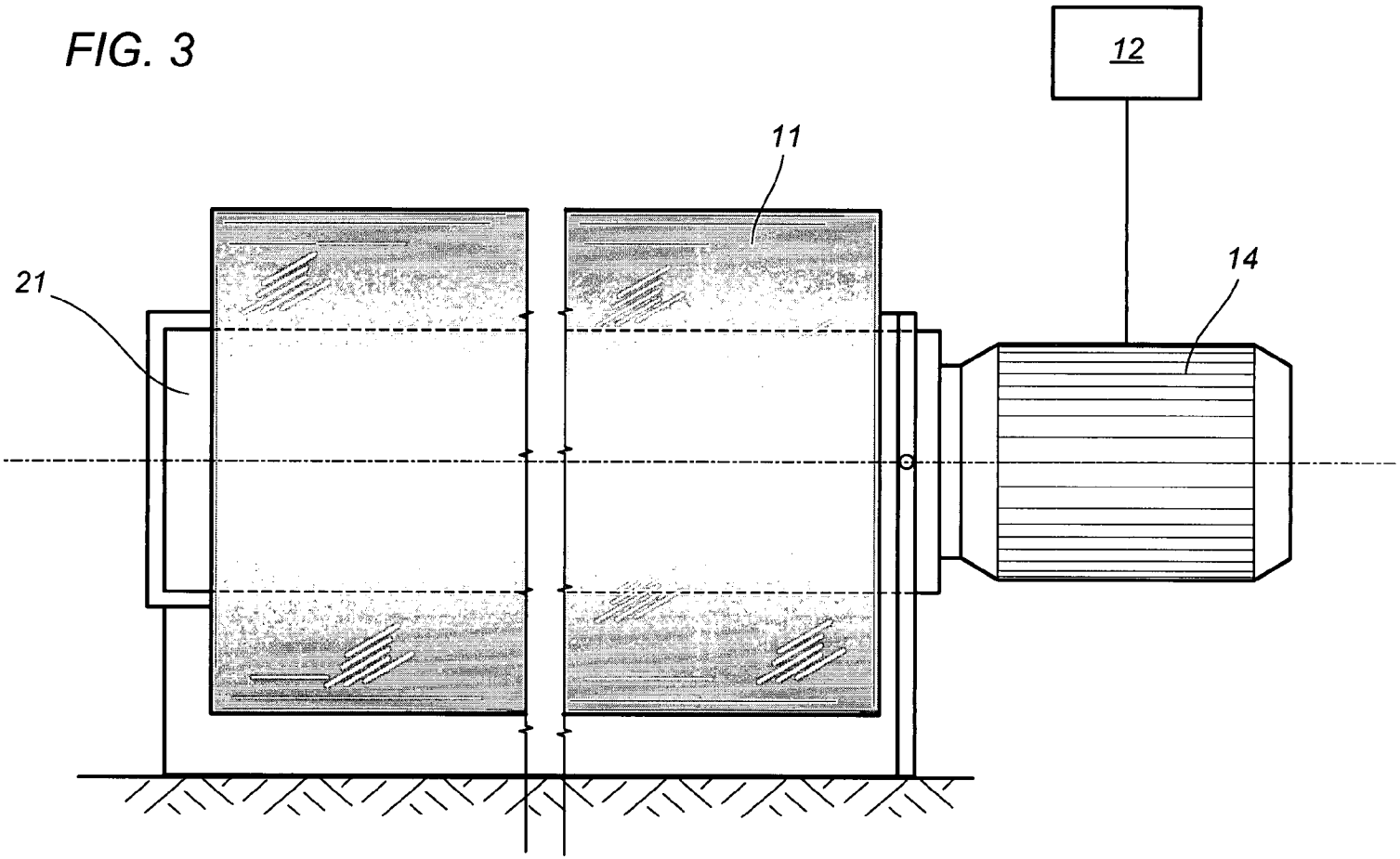
FIG. 3 is a detail E from FIG. 1, showing another embodiment of the apparatus according to the invention in a schematic side view.

In another embodiment, illustrated in FIG. 3, the third electric axis AE3 may be mounted in and operative directly on the roll 11 of film 3.

In this embodiment, too, the third electric axis AE3 may comprise a third variable phase drive 14 axially connected to a rotary drum 21 that supports the roll 11 in such a way as to enable pre-winding speed to be directly correlated to the feed and cutting speed of the feed and cutting unit 8.

The pre-winding unit 10 may further comprise means 22 for controlling the unwound film 3 and which may be positioned between the third electric axis AE3 and the feed and cutting unit 8 and connected directly to the aforementioned control unit 12.

Looking in more detail, the control means 22 comprise:

the aforementioned tubular roller 13 guided on both sides by respective vertical guides 23 (drawn with a broken line in the illustration) and resting on the film 3 being unwound so as to be able to slide freely up and down together with the film 3 (see arrow F2 in FIG. 3);

at least one sensor 24 for detecting the presence of the roller 13 and positioned at a point close to a floor P on which the apparatus 4 rests.

The sensor 24 is connected to the control unit 12 and can send to the control unit 12 a signal S for stopping the second and third electric axes AE2 and AE3 when:

the roller 13 is at a lowered first position with film close to the floor P, that is to say, a position away from the third electric axis AE3, for a length of time greater than a preset time, corresponding to absence of a call for film 3 by the second electric axis AE2; and the roller 13 and the film 3 are at a raised second position, that is to say, close to the third electric axis AE3, for a length of time greater than a preset time, corresponding to absence of film 3 feed by the third electric axis AE3.

Like the third electric axis AE3, the second electric axis AE2 may comprise a second variable phase drive 25, and, in order to present an electronically controlled structure, the first axis AE1 may also be of the electric type with a first variable phase drive 26.

This makes it possible to connect the three electric axes AE1, AE2, AE3 to the control unit 12 (for example, a microprocessor with pre-programmed memory banks) in such manner as to coordinate the respective profiles of motion substantially constituting electric cams for synchronizing the operation of the three drives.

The apparatus structured as described above therefore achieves the aforementioned aims by simply adding to the pre-unwinding unit a drive motor controlled by the units downstream of the pre-unwinding unit itself.

Thus, the unwinding of the film can be synchronized with the calls for film made by the feed and cutting unit according to the size of the product groups to be wrapped.

This structure, besides keeping the apparatus structurally simple, significantly increases not only the reliability of the unwinding system, since the film remains properly tensioned along its entire feed path, but also the productivity of the machine since the units forming part of the apparatus are always synchronized and their drives coordinated by the control unit which controls the form of the electric cams operating on the moving components.

Moreover, the fact that the film can be kept to a straight feed path improves the quality of the wrapped end product without reducing the productivity of the apparatus.

The invention described has evident industrial applications and can be modified in several ways without thereby departing from the scope of the inventive concept. Moreover, all the details of the invention may be substituted by technically equivalent elements.

What is claimed is:

1. An apparatus for wrapping groups of products with film, the apparatus comprising:

a first surface;

a second surface;

wrapping means for wrapping groups of products with a length of film, the wrapping means comprising a first electric drive axis;

a film feed unit for defining a length of film according to dimensions of the group of products to be wrapped, the film feed unit comprising a second electric drive axis for moving a defined quantity of film in the direction of the second surface;

a pre-unwinding unit for pre-unwinding film, said pre-unwinding unit comprising a third electric drive axis to move film from an associated roll of film toward the feed unit;

a synchronizing unit that controls the second and third electric drive axes and that is operative between the second and third electric drive axes to synchronize film feed from the pre-unwinding unit;

a plurality of idle film tensioning rollers defining a film path and located between the film feed unit and the pre-unwinding unit, a first group of at least two of the idle tensioning rollers being fixed in position relative to the third electric drive axis and a second group of at least two of the idle tensioning rollers being mounted on a pivoting rocker arm.

2. An apparatus for wrapping groups (1) of products (2) with film, the apparatus (4) comprising at least the following:

a first surface (5) and a second surface (6), the first surface (5) moving in a direction (A) for conveying the products (2) to the second surface (6) and forming the product groups (1);

wrapping means for wrapping the groups (1) with a length of the film (3), the wrapping means (7) having a first drive axis (AEl);

a film (3) feed unit (8) defining the length of film (3) whose length depends on the dimensions of the group (1) of products to be wrapped, the unit (8) being located below and adjacent to a slot (9) separating the first surface (5) from the second surface (6), the feed unit having a second electric drive axis (AE2) which enables a defined quantity of film (3) to be unwound in the direction of the second surface (6);

a pre-unwinding unit (10) for pre-unwinding the film (3), comprising at least one roll (11) of film (3) located upstream of the feed unit (8) with respect to an unwinding direction (B) and under the first and second surfaces (5, 6);

a third electric drive axis (AE3) located and operative on the pre-unwinding unit (10) to move the film (3) towards the feed unit (8) according to the film (3) requirement or feed speed controlled by the second electric axis (AE2) of the feed unit (8);

a unit (12) which controls the second and third electric axes (AE2, AE3) and which is located and operative between the two electric axes (AE2, AE3) to synchronize the control of film (3) feed;

the apparatus (4) further comprising a plurality of idle film tensioning rollers (30) located between the roll (11) and a pair of film feed rollers (15, 16), a first group of the idle tensioning rollers (30) being fixed on a plate (31) that mounts a third drive (14), and a second group of the idle tensioning rollers (30) being mounted on a rocker arm (32) pivoted on a frame (33) forming part of the apparatus (4).

3. The apparatus according to claim 2, wherein the third electric axis (AE3) is located between the roll (11) and a roller (13) that controls the unwinding of the film (3).

4. The apparatus according to claim 3, wherein the third electric axis (AE3) comprises at least the third drive (14) positioned between the roll (11) and the roller (13), and the pair of film (3) feed rollers (15, 16), one of which is kinematically connected to the third drive (14).

5. The apparatus according to claim 2, wherein the third electric axis (AE3) is located and operative on the film roll (11).

6. The apparatus according to claim 5, wherein the third electric axis (AE3) comprises the third drive (14) axially connected to a rotary drum (21) that supports the roll (11) to enable pre-unwinding speed to be directly correlated to the feed and cutting speed of the feed and cuffing unit (8).

7. The apparatus according to claim 2, wherein the third electric axis (AE3) comprises at least the third drive (14) positioned between the roll (11) and the roller (13), and the pair of film (3) feed rollers (15, 16), one of which is kinematically connected to the third drive (14).

8. The apparatus according to claim 7, wherein the roller (15) and the third drive (14) are kinematically connected by a toothed belt (17) trained around respective wheels (18, 19) keyed, respectively, to the roller (15) and to a shaft (20) protruding from the third drive (14).

9. The apparatus according to claim 7, wherein the third drive (14) is a variable phase drive.

10. The apparatus according to claim 2, wherein the third electric axis (AE3) comprises the third drive (14) axially connected to a rotary drum (21) that supports the roll (11) to enable pre-unwinding speed to be directly correlated to the feed and cutting speed of the feed and cutting unit (8).

11. The apparatus according to claim 2, wherein the pre-unwinding unit (10) further comprises means (22) for controlling the unwound film (3) wherein said means for controlling the unwound film is positioned between the third electric axis (AE3) and the feed and cutting unit (8) and connected directly to the control unit (12).

12. The apparatus according to claim 11, wherein the control means (22) comprise:

a tubular roller (13) guided on both sides by respective vertical guides (23) and resting freely on the film (3) being unwound and sliding freely up and down together with the film (3); and at least one sensor (24) for detecting the presence of the roller (13) and positioned at a point close to a floor (P); the sensor (24) being connected to the control unit (12) to send to the control unit (12) a signal (S) for stopping the second and the third electric axes (AE2, AE3) when:

the roller (13) is at a lowered first position with the film close to the floor (P), wherein the roller (13) is in a position away from the third electric axis (AE3), for a length of time greater than a preset time, corresponding to absence of a call for film (3) by the second electic axis (AE2), and the roller (13) and the film (3) are at a raised second position, close to the third electric axis (AE3), for a length of time greater than a preset time, corresponding to absence of film (3) feed by the third electric axis (AE3).

13. The apparatus according to claim 2, wherein the first drive axis (AE1) is of the electric type.

14. The apparatus according to claim 13, wherein the first and second power drive axes (AE1, AE2) comprise, respectively, a first variable phase drive (26) and a second variable phase drive (25).

15. The apparatus according to claim 2, wherein the first and second power driven axes (AE1, AE2) comprise, respectively, a first variable phase drive (26) and a second variable phase drive (25).

16. The apparatus according to claim 15, wherein the control unit (12) is connected to the first (AE1), second (AE2) and third (AE3) electric axes to coordinate the respective profiles of motion substantially constituting electric cams.

17. The apparatus according to claim 2, wherein the control unit (12) is connected to the first (AE1), second (AE2) and third (AE3) electric axes to coordinate the respective profiles of motion substantially constituting electric cams.

* * * * *